United States Patent [19]

Somarakis

[11] Patent Number: 4,747,752

[45] Date of Patent: May 31, 1988

[54] SEALING AND DYNAMIC OPERATION OF A LIQUID RING PUMP

[75] Inventor: John Somarakis, Vancouver, Wash.

[73] Assignee: Somarakis, Inc., Vancouver, Wash.

[21] Appl. No.: 40,561

[22] Filed: Apr. 20, 1987

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 722,219 | 3/1903 | Fielden . | |
| 1,766,751 | 6/1930 | Jennings . | |
| 2,312,837 | 3/1943 | Jennings . | |
| 2,416,538 | 2/1947 | Nelson . | |
| 2,534,530 | 12/1950 | Perry | 286/8 |
| 3,209,987 | 10/1965 | Jennings . | |
| 3,289,918 | 12/1966 | Adams | 417/68 |
| 3,303,991 | 2/1967 | Dardelef | 417/68 |
| 3,938,832 | 2/1976 | Preston | 285/157 |
| 4,111,500 | 9/1978 | Ando | 308/187 |
| 4,132,504 | 1/1979 | Fitch | 417/68 |
| 4,273,343 | 6/1981 | Visser | 277/53 |
| 4,301,893 | 11/1981 | St. Jean | 184/24 |
| 4,323,252 | 4/1982 | Lagana | 277/12 |
| 4,426,088 | 1/1984 | Ernst | 277/14 |
| 4,498,844 | 2/1985 | Bissell | 417/68 |

FOREIGN PATENT DOCUMENTS

| | | | |
|---|---|---|---|
| 188951 | 1/1937 | Switzerland | 417/68 |
| 361310 | 1/1973 | U.S.S.R. | 417/68 |

*Primary Examiner*—William L. Freeh

*Attorney, Agent, or Firm*—W. Scott Carson

[57] ABSTRACT

Improvements in the sealing area and dynamic operation of liquid ring pumps. The sealing improvement involves providing aspirating means between the cone inlet and the fluid adjacent the shaft on the inboard or high pressure side of the sealing area. In operation, the high pressure fluid that would tend to leak past the seal in prior art to contaminate the bearings or create a potentially dangerous gas explosion is harmlessly aspirated off into the gas being drawn into the pump. Further, in doing so, the sealing properties of the pump seal are enhanced. The dynamic improvement is directed particularly to duplex liquid ring pumps and calls for the rotor blades on one side of the central partition to be offset or out of phase from the mirror-image rotor blades on the other side of the partition. In this manner, the offset rotor blades in the adjacent pump chambers have a counter balancing effect to improve the operation of the pump by reducing the amplitude of the dynamic pulsations resulting in a pump with smoother operation and longer life.

27 Claims, 6 Drawing Sheets

SEALING AND DYNAMIC OPERATION OF A LIQUID RING PUMP

BACKGROUND OF THE INVENTION

1. Field of Invention

This invention relates to the field of liquid ring pumps.

2. Background Discussion

Liquid ring pumps are widely used in industrial and other applications to pump air or other gases. In a typical application, water or other liquid is introduced into the pump and centrifugally flung outwardly by a rotating rotor to form an annular ring of liquid within the stationary pump housing. The liquid ring rotates with the rotor and is centered about the longitudinal axis of the housing. The rotational axis of the rotor, however, is offset from the axis of the housing. Consequently, as the liquid ring rotates with the rotor, an air core or pocket is formed at the center of the annular liquid ring wherein the air core like the liquid ring is also centered relative to the housing axis but offset from and eccentrically positioned relative to the shaft axis.

The liquid volume in the housing is maintained to provide a seal at the outer portions of the rotor blades isolating individual chambers between adjacent blades. In one complete rotation of the rotor, liquid will first fill a chamber and then recede as the chamber advances about the housing until the chamber is almost empty of liquid wherein the chamber again fills with liquid to complete a cycle. As the liquid recedes from the chamber, it is replaced by air or other gas entering the inlet of the pump. Then, as the liquid is forced back into the rotor chamber, the air is compressed and exits through the outlet of the pump.

Two problems that presently occur in liquid ring pumps are outward leakage of fluid past the shaft seals and dynamic imbalance of the operating pump. In regard to the first problem, the liquid introduced into the liquid ring pump to form the annular ring commonly enters the pump and fills the space adjacent the shaft between the pump cone and the shaft. It then flows outwardly through passages in the cone or between the cone and the base of the rotor. The problem subsequently arises that liquid and/or gas under the pressure generated by the pump tends to leak past the shaft seal from the inboard or high pressure side of the seal to the outboard or low pressure side of the seal. Such leakage can contaminate the bearings and if the bearings are contaminated, it becomes a very expensive and time consuming ordeal to disassemble the pump and repair or repack the sealing area. Also, if the gas being pumped is combustible such as methane or gasoline fumes, exterior leakage of the fumes past the seal area can result in a potentially dangerous explosion.

Attempts to control outboard leakage after it has occurred and fluid has passed through the sealing area are known as in U.S. Pat. Nos. 4,273,343 to Visser; 2,312,837 to Jennings; and 722,219 to Fielden. However, these prior art approaches are essentially trying to clean up and contain the problem (i.e., leakage past the sealing area) after it has occurred while the present invention attempts to prevent the problem (i.e., leakage past the seal area) before it happens. In doing so, the present invention aspirates away fluid adjacent the rotating shaft and fixed cone on the inboard or high pressure side of the seal and harmlessly draws it into the pump itself. In this manner, the sealing properties of the pump seal are enhanced and the leakage problem virtually eliminated to the extent that simple lip seals can be used if desired in applications that previously called for much more expensive and harder to maintain and install sealing arrangements.

In regard to the second problem of dynamic imbalance particularly in duplex liquid ring pumps which essentially have two mirror-image pumping chambers on either side of a central partition, several U.S. patents have addressed the problem but in rather complex terms. For example, in U.S. Pat. No. 3,209,987, Jennings addressed the problem of balancing the bending moments on the pump shaft by offsetting the inlets and outlets and housing structure of the adjacent pumping chambers by 180 degrees. In his earlier U.S. Pat. No. 1,766,751, Jennings also attempted to improve dynamic balance by facing the curved blades of each rotor section in different directions, staggering the lobes, and crossing or laterally displacing the water and fluid being pumped from one side of the rotor to the other. Similarly, Nelson in his U.S. Pat. No. 2,416,538 continues along the crossover theme of Jennings by articulating only the outer portions of each blade combined with the crossing or laterally displacing of the water and fluid being pumped from one side of the rotor as in Jennings.

In contrast, the present invention addresses and improves the dynamic operation of a duplex liquid ring pump by simply offsetting the blades in each rotor section. In doing so, the rotor blades on one side of the central partition are then staggered or out of phase from the mirror-image rotor blades on the other side of the partition in the adjacent pumping chamber.

SUMMARY OF THE INVENTION

This invention relates to improvements in the sealing area and dynamic operation of liquid ring pumps. In regard to the sealing improvement, the invention involves providing aspirating means between the cone inlet and the fluid adjacent the shaft on the inboard or high pressure side of the sealing area. In operation, the high pressure fluid that would tend to leak past the seal in prior art to contaminate the bearings or create a potentially dangerous gas explosion is harmlessly aspirated off into the gas being drawn into the pump. Further, in doing so, the sealing properties of the pump seal are enhanced to the extent that simple lip seals can be used if desired in pumps that previously required more elaborate and expensive and harder to maintain sealing arrangements.

In reference to the dynamic improvement, it is directed particularly to duplex liquid ring pumps and calls for the rotor blades on one side of the central partition to be offset or out of phase from the mirror-image rotor blades on the other side of the partition. In this manner, the offset rotor blades in the adjacent pump chambers have a counter balancing effect to improve the operation of the pump by reducing the amplitude of the dynamic pulsations resulting in a pump with smoother operation and longer life.

DETAILED DESCRIPTION OF THE PREFERRED EMBODIMENTS

Figure 1:
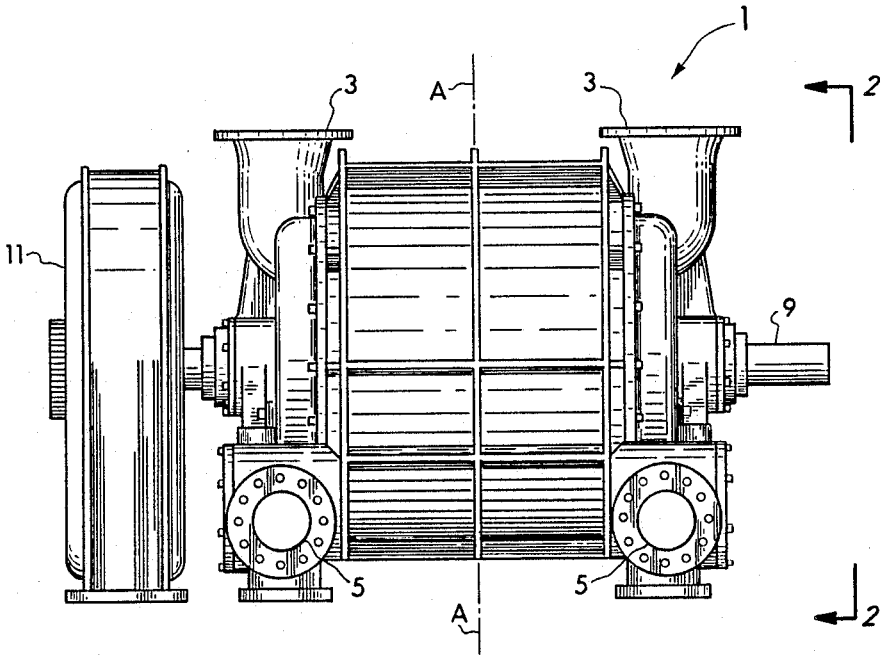
FIG. 1 is a side view of a duplex liquid ring pump.
Figure 2:
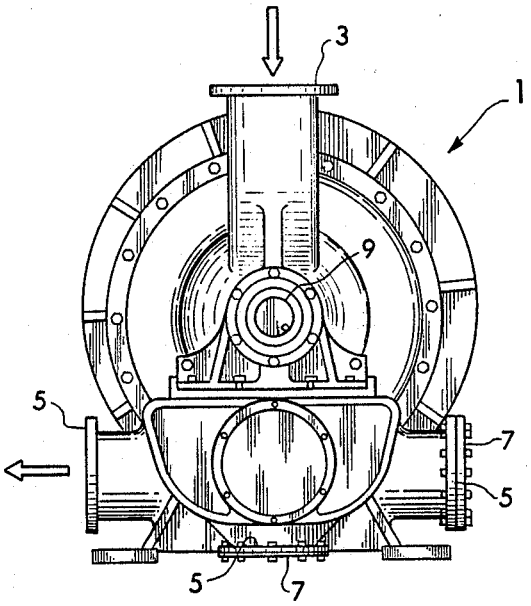
FIG. 2 is an end view of the pump taken along lines 2—2 of FIG. 1.
Figure 3:
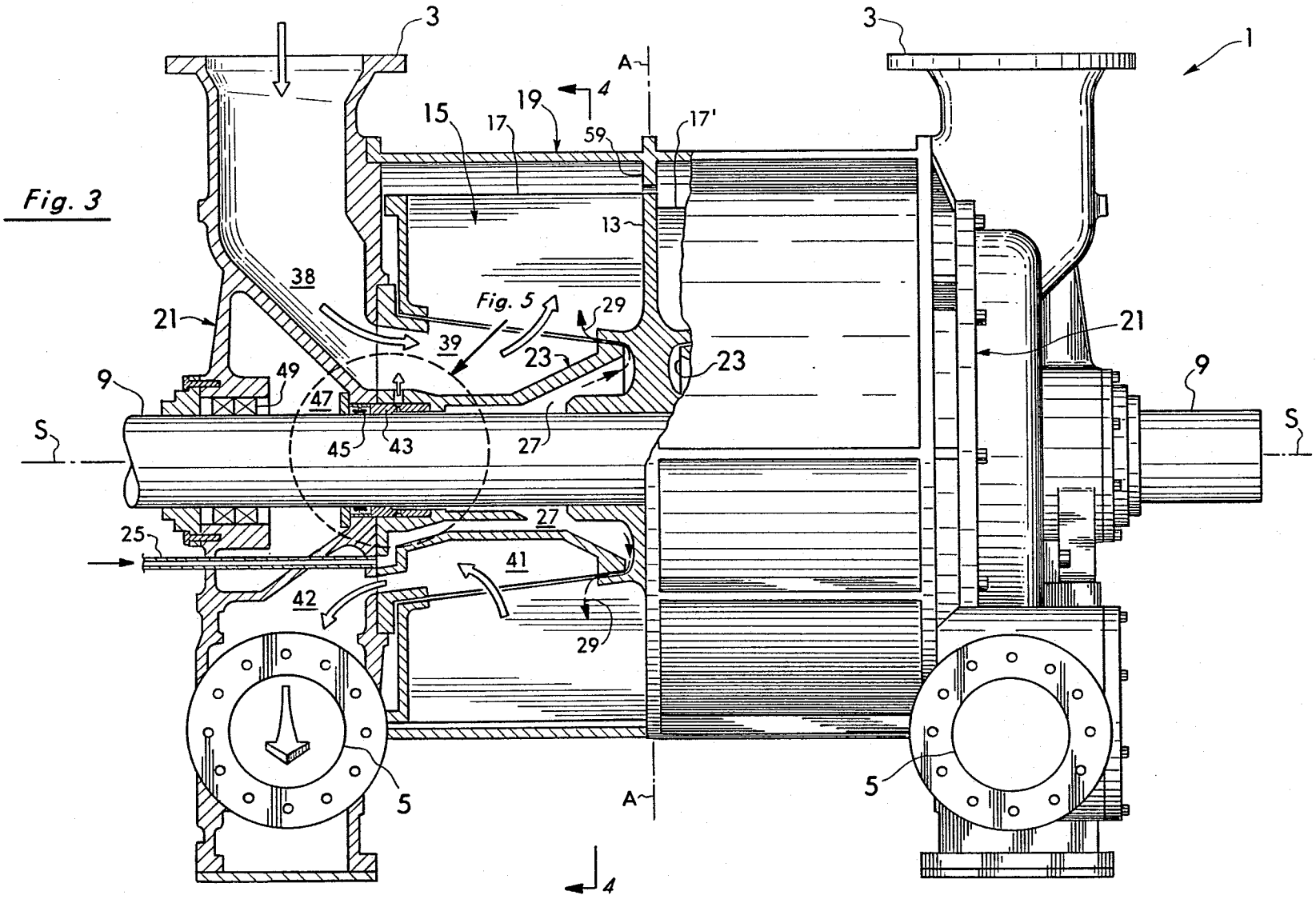
FIG. 3 is a partial cross-sectional view of the pump of the present invention.

As best seen in FIGS. 1-3, the liquid ring pump 1 of the preferred embodiment is a duplex one with mirror-image inlets 3 and outlets 5 on either side of the central plane A—A. In operation, any one of the multiple outlets 5 on each side can be used (see FIG. 2) depending upon the desired delivery orientation with the unused outlets 5 being closed by cover plates 7. The shaft 9 of the pump 1 can be driven by any desired arrangement including a simple drive motor such as 11 of FIG. 1.

Referring to FIG. 3, the shaft 9 of the pump 1 extends along a longitudinal axis S—S substantially perpendicular to the central plane A—A and central partition 13 of the rotor 15. The rotor 15 includes a plurality of blades 17 and 17' mounted on either side of the central partition 13. The rotor 15 with its blades 17 and 17' and central partition 13 is fixedly mounted to the shaft 9 and rotates with it relative to the annular pump housing 19 and the head members 21 and the cone members 23 on each side of the central plane A—A.

In operation as best seen in FIG. 3, water or other liquid is first introduced through the line 25 into the pump 1 to the space at 27 between the cone 23 and shaft 9. From there it flows outwardly along path 29 between the fixed cone 23 and rotating rotor 15 into the pump housing 19 where the rotating rotor causes it to form a liquid ring 31 (see FIG. 4). The annular ring 31 formed by the rotating rotor 15 is symetrically centered about the longitudinal axis H (see FIG. 4) of the housing 19. As shown, the longitudinal axis S—S of the shaft 9 is substantially parallel to but eccentrically offset from the longitudinal axis H of the housing 19. In this manner, an air core or pocket 33 is formed which like the liquid ring 31 is centered about the housing axis H and offset and eccentrically positioned relative to the shaft axis S.

Figure 4:
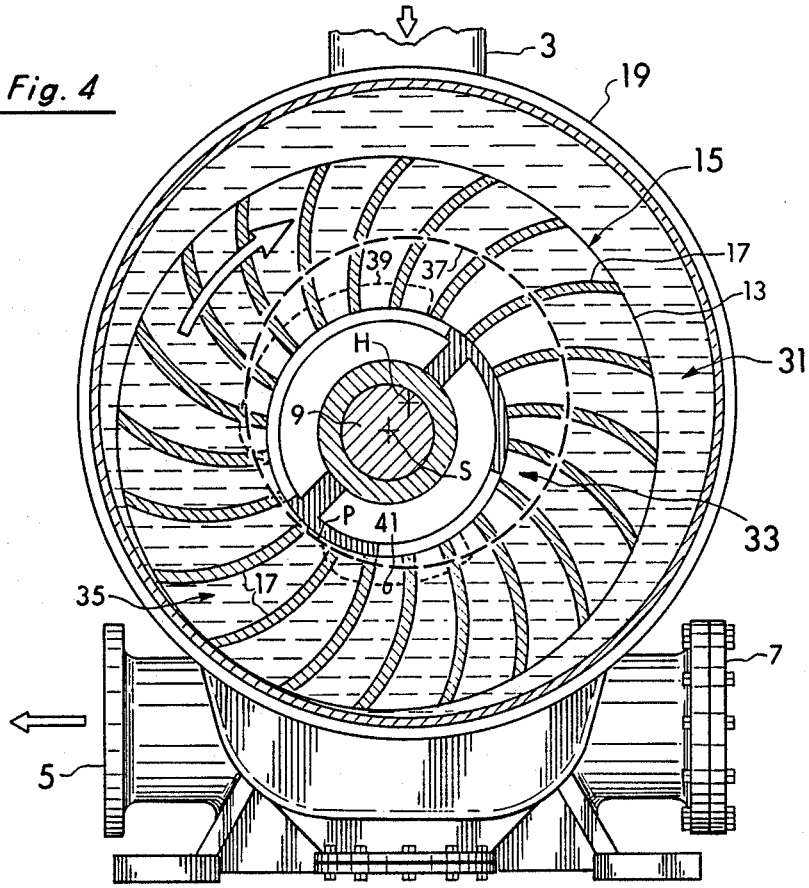
FIG. 4 is a partial cross-sectional view taken generally along line 4—4 of FIG. 3 schematically illustrating the overall operation of the pump.

Consequently, as the rotor 15 makes a complete clockwise revolution from location P at about seven o'clock in FIG. 4, the liquid first fills a chamber 35 between adjacent blades 17. Then, as the chamber 35 advances clockwise in FIG. 4 about the shaft axis S, the liquid in the chamber 35 recedes (see the liquid-gas interface 37 at about one o'clock in FIG. 4). Thereafter, the chamber 35 again fills with liquid as it approaches location P to complete a cycle. As the liquid recedes from the chamber 35 as it moves clockwise from location P to about one o'clock in FIG. 4, the liquid 31 is replaced by air or other gas 33 entering the pump through the inlet 39 in the cone member 23. Then as the liquid 31 is forced back into the chamber 35, the air 33 is compressed and exits through the outlet 41 in the cone member 23 (just before location P at about five-seven o'clock in FIG. 4). The air or other gas from inlet 3 is thus drawn through inlet passage 38 and 39 (see FIG. 3) in the port means of head member 21 and cone member 23 into the rotor 15 where it is compressed and then discharged through the outlet passages 41 and 42. The liquid 31 to form the annular ring enters the pump 1 as discussed above through inlet 25 (see FIG. 3). It then fills the space or chamber 27 between the cone 23 and shaft 9 and flows outwardly through make-up passage 29 between the cone 23 and rotor 15. As also discussed above, the problem subsequently arises that liquid 31 and/or gas 33 in the space or chamber 27 is subjected to the pressure generated by the pump 1. Without the aspirating feature of the present invention, this fluid would tend to leak past the shaft seal 45 (i.e., from right to left in FIGS. 3 and 5). In doing so in prior art devices without the aspirating feature of the present invention, the fluid of liquid 31 and/or gas 33 is driven by the pressure differential between chamber 27 (which is substantially under the full, discharge pressure of the pump 1) and the outboard area 47 (which is substantially at ambient, atmospheric pressure). If allowed to leak past the shaft seal 45 in FIG. 5 from the inboard or high pressure side HP (on the right of plane B—B in FIG. 5) to the outboard or low pressure side LP of the seal 45 (on the left of plane B—B in FIG. 5), the escaping fluid can contaminate the main bearings 49 (see FIG. 3). Further, if the fluid contains combustible fumes, it may well result in a potentially dangerous explosion.

Figure 5:
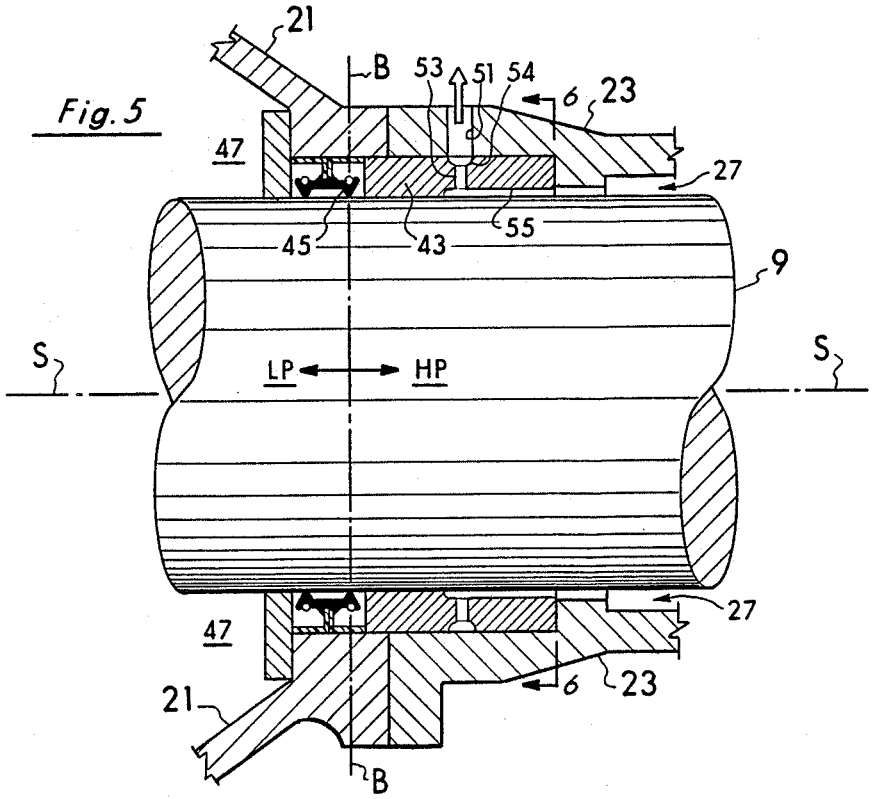
FIG. 5 is an enlarged view of the sealing area depicted in FIG. 3 illustrating the aspirating feature of the present invention.
Figure 7:
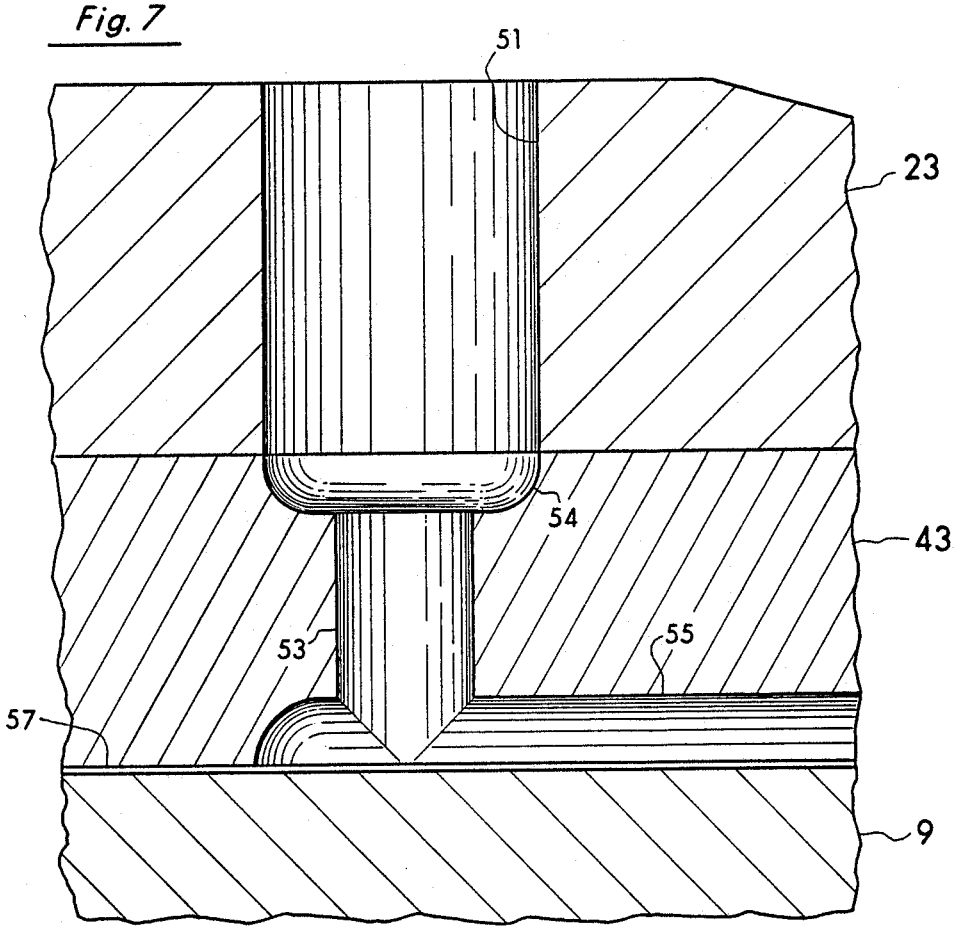
FIG. 7 is an enlarged view taken along line 7—7 of FIG. 6.

To prevent this leakage problem and enhance the sealing operation of the lip seal 45, the sealing area of the pump 1 on the inboard or high pressure side HP of the seal 45 is provided with an aspirating means. The aspirating means places the high pressure fluid adjacent the shaft 9 in space 27 in fluid communication with the low pressure generated in the pump 1 itself. In this manner, the leakage problem of prior art devices caused by the large pressure differential across the sealing area is defused and the high pressure fluid in chamber 27 is harmlessly drawn into the inlet flow of the pump 1. In the preferred embodiment as shown in FIG. 5, the aspirating means includes a flow passage comprising channel portion 51 in the cone 23 and the channel portions 53, 54, and 55 in the secondary bearing 43. The secondary bearing 43 (see FIG. 7) is actually spaced at 57 from the shaft 9 in a non-sealing relationship by tolerances substantially twice that of the main bearing 49. The secondary bearing 43 in operation is intended to limit damage to the pump 1 should the main bearings 49 break down.

As shown, the liquid is introduced at 25 in FIG. 3 and subsequently admitted into the chamber 27 and thereafter into the housing 19 through the make-up passage way 29. The chamber 27 is defined by parts of the cone 23 and head 21 which are fixedly mounted relative to the housing 19. These parts form a portion that extends about and along the shaft 9 and is radially spaced from the shaft 9 to define or form the chamber 27. As illustrated in FIGS. 3, 5, and 7–9, the chamber 27 extends longitudinally (from left to right in the figures) along the shaft 9 from a first location (on the left in the figures) at the seal line B to a longitudinally spaced second location (on the right) at rotor 13. The make-up passage 29 then adds liquid to the housing 19 from the right side of the chamber 27 and the aspirating means then draws fluid from the left side of the chamber 27 at the high pump pressure (from next to the shaft 9 substantially adjacent the seal line B on the left side of chamber 27). As shown, the make-up passage 29 and aspirating means including channel portions 53–55 are essentially at opposite sides or ends of the chamber 27. That is, the make-up passage 29 is positioned at or at least substantially closer to the second location or right side of the chamber 27 near the rotor 13 than to the first location at the seal line B on the left side of chamber 27 in the figures. Conversely, the aspirating means is located substantially closer to the first location or the left side of the chamber 27 than to the make-up passage 29 or the right side of the chamber 27.

Figure 6:
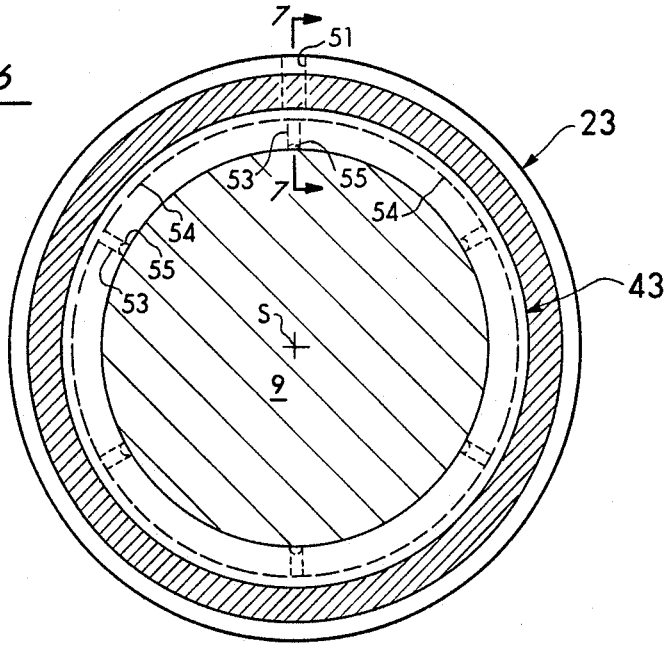
FIG. 6 is a view taken along line 6—6 of FIG. 5 further illustrating portions of the aspirating feature of the present invention.

Referring again to FIGS. 5–7, the channel portion 51 in the cone 23 extends radially through the cone 23 relative to the longitudinal axis S—S of the shaft 9. Similarly, the channel portion 53 and part of 54 also extend radially. The connecting channel 55 (see FIGS. 5 and 7) then extends at a right angle thereto along the shaft 9 substantially parallel to the shaft axis S. In the preferred embodiment, the aspirating means has a plurality of such passages with the respective channel portions 55 (see FIG. 6) extending parallel to each other and being radially and evenly spaced from each other about the shaft axis S. Interconnecting all of the channel portions 53 and 55 is the circumferential channel portion 54 that extends about the shaft axis S. In this manner, all of the aspirating passages of channel portions 53–55 are in fluid communication with each other as well as in fluid communication with the high pressure fluid adjacent shaft 9. Additionally, the channel portions 53–55 are all in fluid communication with the channel portion 51 and consequently, they are also all in fluid communication with the low pressure gas in the inlet passage 38, 39 of the pump 1.

Figure 8:
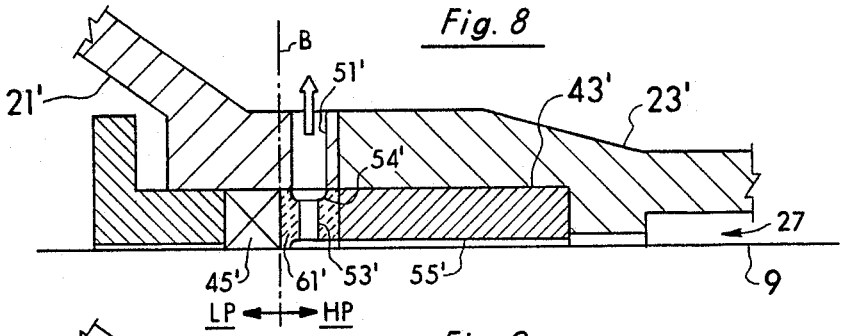
FIG. 8 illustrates an alternate adaptation of the aspirating feature of the present invention.
Figure 9:
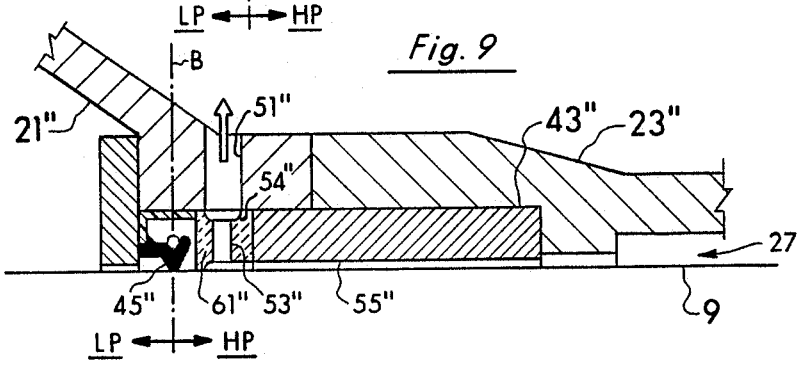
FIG. 9 illustrates another alternate adaptation of the aspirating feature of the present invention.

FIGS. 8 and 9 illustrate adaptations of the aspirating feature to other sealing arrangements. However, in each case as in the preferred embodiment, the aspirating means is positioned on the inboard or high pressure side HP of the packing seal 45′ in FIG. 8 and the lip seal 45″ in FIG. 9. Additionally, the secondary bearings 43′ and 43″ are also in a non-sealing relationship to the shaft 9 at tolerances substantially twice those of the main bearings 49. However, in the embodiments of FIGS. 8 and 9, the aspirating channel portions 53′ and 54′ and 53″ and 54″ and portions of channels 55′ and 55″ are in separate ring members 61′ and 61″ which are preferably in a non-sealing relationship to the shaft 9 like the secondary bearings 43′ and 43″. Further, the channel portions 51′ and 51″ in the adaptations of FIGS. 8 and 9 lead to the inlet passage 38, 39 of the pump 1 through the head member 21′ and 21″. This is in contrast to the channel portion 51 in the preferred embodiment which passes through the cone 23 rather than the head member 21.

Figure 10:
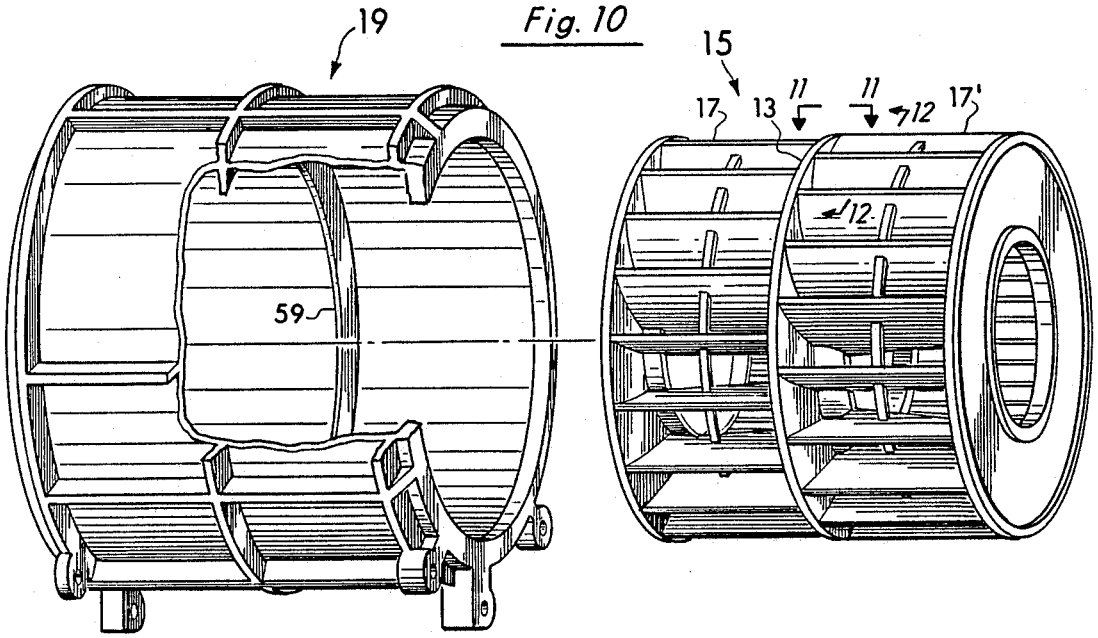
FIG. 10 is an exploded view of the pump housing and duplex rotor illustrating the offset or out of phase nature of the blades on each side of the central partition of the rotor.
Figure 11:
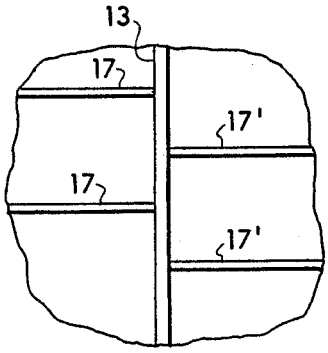
FIG. 11 is a schematic view taken generally along line 11—11 of FIG. 10 and line 11—11 of FIG. 12 illustrating the offset or staggered relationship of the rotor blades in the adjacent pumping chambers.
Figure 12:
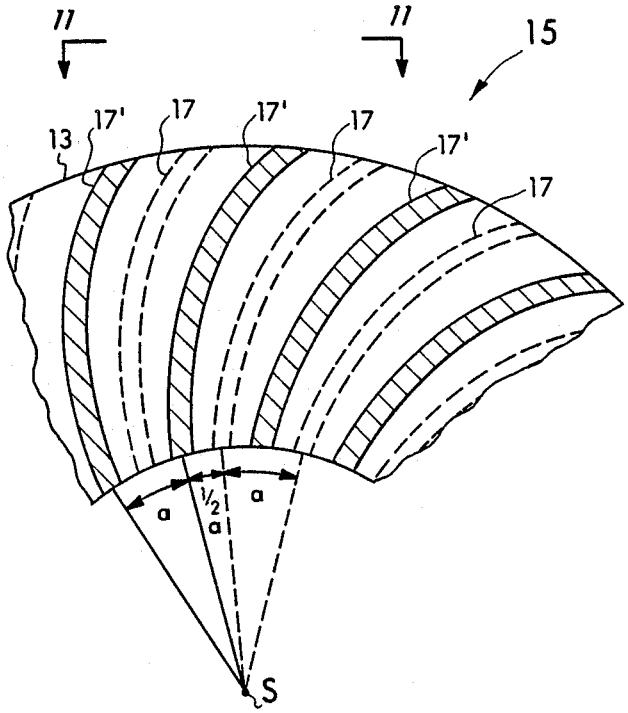
FIG. 12 is a schematic view taken generally along line 12—12 of FIG. 10 further illustrating the offset relationship between the blades on each side of the central partition of the rotor.

The second feature of the present invention is illustrated in FIGS. 10–12 and is directed to improving the dynamic balance of the duplex liquid ring pump 1. More specifically and as illustrated in the exploded view of FIG. 10, the rotor 15 of the duplex liquid ring pump has two rotor sections on either side of the central partition 13. The central partition 13 as best seen in FIG. 3 separates the pump 1 into two pumping chambers on either side of the central plane A—A of the pump 1. Each pumping chamber has its own inlet 3 and outlets 5 and the central partition 13 cooperates with the central rib 59 of the housing 19 to essentially separate the operations of the two pumping chambers. The rotor blades 17 in one pumping chamber extend about the rotor in a manner corresponding to the blades 17′ in the other pumping chamber; but, unlike prior art devices, the first set of blades 17 are offset from the second set of blades 17′. This improves the operation of the pump by reducing the amplitude of the dynamic pulsations resulting in smoother operation and longer life.

In the preferred embodiment as shown in FIGS. 11 and 12, the blades 17 and 17′ are evenly offset relative to each other. That is, if there were n blades 17 and n blades 17′, adjacent blades 17 in one rotor section would be spaced angle a (see FIG. 12) or 360/n degrees from each other. Similarly, adjacent blades 17′ would be spaced angle a or 360/n degrees from each other about the shaft axis S. Additionally, the offset or out of phase amount would be ½ a or 360/2n degrees. For example, if each set of rotor blades has 20 blades, adjacent blades in each set would be evenly spaced 360/20 or 18 degrees from each other about the axis S. Additionally, each rotor set would be one-half that or 9 degrees out of phase with the mirror-image set of blades on the other side of the central partition 13. As shown, each blade 17 and 17′ respectively extends along and substantially radially outwardly of the shaft axis S. Further, as shown in FIGS. 4 and 12, the blades 17 and 17′ also preferably curve slightly in a continuous and uniform manner in the direction of rotation for enhanced operation of the pump.

While several embodiments of the present invention have been shown and described in detail, it is understood that various changes and modifications could be made thereto without departing from the scope of the invention.

I claim:

1. A liquid ring pump having:

an annular housing extending along a longitudinal axis, a shaft extending along a longitudinal axis and means for mounting said shaft for rotation about the longitudinal axis thereof with the longitudinal axis of said shaft substantially parallel to and spaced from the longitudinal axis of said housing wherein said shaft is eccentrically positioned within said housing, a rotor fixedly mounted on said shaft and having a plurality of blades, each of blades extending along and substantially radially outwardly of the shaft relative to the longitudinal axis of said shaft, said blades being spaced from one another about said shaft relative to the longitudinal axis of said shaft, means for introducing liquid into said housing wherein said rotating shaft and rotor create an annular ring of liquid extending substantially symmetrically about the longitudinal axis of said housing and eccentrically about the longitudinal axis of said shaft, said liquid introducing means including a portion fixedly mounted relative to said housing, said portion extending about and along said shaft and radially spaced from said shaft to define a chamber between said portion and said shaft, said chamber extending longitudinally along said shaft from a first location to at least a second location, said second location being longitudinally spaced from said first location along said shaft, said liquid introducing means further including means for admitting liquid into said chamber and further including means for admitting liquid from said chamber into said housing through at least one make-up passage located substantially closer to said second location than to said first location, port means fixedly mounted relative to said housing, said port means having an inlet passage for admitting gas into said rotor and an outlet passage for discharging gas from said rotor, said liquid ring pump drawing gas into said rotor through said inlet passage at a first pressure and discharging said gas from said rotor through said outlet passage at a second, higher pressure, sealing means extending between said portion of said liquid introducing means and said shaft at said first location of said chamber for sealingly engaging said shaft and said portion of said liquid introducing means radially about the longitudinal axis of said shaft to prevent fluid and fluid pressures generated in said pump from passing between said fixed portion of said liquid introducing means and said rotating shaft, said sealing means defining and separating an inboard side including said chamber subjected to the pressures generated by said pump and an outboard side isolated and sealed from the chamber and the pressures generated by said pump, said chamber and said inboard side of said sealing means being subjected substantially to the full, second pressure generated by said pump, and means located substantially closer to said first location of said chamber than to said second location for aspirating fluid at said second, higher pressure from next to said shaft in said chamber on the inboard side of said sealing means substantially adjacent said first location, said aspirating means including at least one passage extending between and in fluid communication with the fluid in said chamber adjacent said shaft at said second, higher pressure and the inlet passage of said port means and said gas at said higher pressure wherein said fluid at said second, higher pressure next to said shaft on the inboard side of said sealing means substantially adjacent said first location is aspirated into the gas being drawn into the rotor through the inlet passage of said port means.

2. The liquid ring pump of claim 1 wherein said portion of said liquid introducing means is also a portion of said port means.

3. The liquid ring pump of claim 1 wherein said sealing means includes a lip seal.

4. The liquid ring pump of claim 1 wherein said outboard side of said sealing means is under a third pressure and said first pressure of said gas being drawn into said rotor through said inlet passage in said port means is less than said third pressure.

5. The liquid ring pump of claim 4 wherein said third pressure is ambient, atmospheric pressure.

6. The liquid ring pump of claim 1 wherein said port means includes a head member having a gas inlet and outlet and said portion of said liquid introducing means extending about and along said shaft is a cone member having a gas inlet and outlet.

7. The liquid ring pump of claim 6 wherein said at least one passage of said aspirating means includes a first channel portion extending through said cone member.

8. The liquid ring pump of claim 7 wherein said first channel portion extends radially through said cone member relative to the longitudinal axis of said shaft.

9. The liquid ring pump of claim 8 wherein said at least one passage of said aspirating means includes a second channel portion in fluid communication with said first channel portion extending substantially at a right angle thereto substantially parallel to the longitudinal axis of said shaft.

10. The liquid ring pump of claim 6 wherein said at least one passage of said aspirating means includes a first channel portion extending through said head member.

11. The liquid ring pump of claim 10 wherein said first channel portion extends radially through said head member relative to the longitudinal axis of said shaft.

12. The liquid ring pump of claim 11 wherein said at least one passage of said aspirating means includes a second channel portion in fluid communication with said first channel portion extending substantially parallel to the longitudinal axis of said shaft.

13. The liquid ring pump of claim 1 wherein said aspirating means includes a plurality of passages in fluid communication with the fluid adjacent said shaft and the inlet passage of said port means, each of said passages of said aspirating means including a channel portion extending along said shaft substantially parallel to each other and radially spaced from each other about the longitudinal axis of said shaft.

14. The liquid ring pump of claim 13 wherein said plurality of passages of said aspirating means are in fluid communication with each other.

15. A liquid ring pump having:

an annular housing extending along a longitudinal axis, a shaft extending along a longitudinal axis and means for mounting said shaft for rotation about the longitudinal axis thereof with the longitudinal axis of said shaft substantially parallel to and spaced from the longitudinal axis of said housing wherein said shaft is eccentrically positioned within said housing, a rotor fixedly mounted on said shaft and having a plurality of blades, each of blades extending along and substantially radially outwardly of the shaft relative to the longitudinal axis of said shaft, said blades being spaced from one another about said shaft relative to the longitudinal axis of said shaft, port means fixedly mounted relative to said housing, said port means having an inlet passage for admitting gas into said rotor and an outlet passage for discharging gas from said rotor, said liquid ring pump drawing gas into said rotor through said inlet passage at a first pressure and discharging said gas from said rotor through said outlet passage at a second, higher pressure, sealing means extending between said port means and said shaft for sealingly engaging said shaft and said port means radially about the longitudinal axis of said shaft to prevent fluid and fluid pressures generated in said pump from passing between said fixed port means and said rotating shaft, said sealing means defining and separating an inboard side subjected to the pressures generated by said pump and an outboard side isolated and sealed from the pressures generated by said pump, said inboard side of said sealing means being subjected substantially to the full, second pressure generated by said pump, and wherein said shaft mounting means includes main bearings mounted within a first tolerance about said shaft on the outboard side of said sealing means and said liquid ring pump further includes a secondary bearing mounted within a second tolerance greater than said first tolerance about said shaft on the inboard side of said sealing means and said at least one passage of said aspirating means passes through said secondary bearing.

16. The liquid ring pump of claim 15 wherein said sealing means includes a lip seal.

17. The liquid ring pump of claim 15 wherein said outboard side of said sealing means is under a third pressure and said first pressure of said gas being drawn into said rotor through said inlet passage in said port means is less than said third pressure.

18. The liquid ring pump of claim 17 wherein said third pressure is ambient, atmospheric pressure.

19. The liquid ring pump of claim 15 wherein said port means includes a head member having a gas inlet and outlet and a cone member extending about and along said shaft and having a gas inlet and outlet, said cone member having portions radially spaced from said shaft wherein said fluid being aspirated from adjacent said shaft is aspirated from the space between the shaft and said cone portions on the inboard side of said sealing means.

20. The liquid ring pump of claim 19 wherein said at least one passage of said aspirating means includes a first channel portion extending through said cone member.

21. The liquid ring pump of claim 20 wherein said first channel portion extends radially through said cone member relative to the longitudinal axis of said shaft.

22. The liquid ring pump of claim 21 wherein said at least one passage of said aspirating means includes a second channel portion in fluid communication with said first channel portion extending substantially at a right angle thereto substantially parallel to the longitudinal axis of said shaft.

23. The liquid ring pump of claim 19 wherein said at least one passage of said aspirating means includes a first channel portion extending through said head member.

24. The liquid ring pump of claim 23 wherein said first channel portion extends radially through said head member relative to the longitudinal axis of said shaft.

25. The liquid ring pump of claim 24 wherein said at least one passage of said aspirating means includes a second channel portion in fluid communication with said first channel portion extending substantially parallel to the longitudinal axis of said shaft.

26. The liquid ring pump of claim 15 wherein said aspirating means includes a plurality of passages in fluid communication with the fluid adjacent said shaft and the inlet passage of said port means, each of said passages of said aspirating means including a channel portion extending along said shaft substantially parallel to each other and radially spaced from each other about the longitudinal axis of said shaft.

27. The liquid ring pump of claim 26 wherein said plurality of passages of said aspirating means are in fluid communication with each other.

* * * * *